United States Patent [19]

Ogawa et al.

[11] 4,448,404

[45] May 15, 1984

[54] DEVICE FOR HOLDING A SHEET-LIKE SAMPLE

[75] Inventors: Koji Ogawa, Yokohama; Yoshihiko Ohtsuki, Chigasaki; Yoshihiko Kudo, Tokyo; Hideo Maeda, Hoya; Naoto Kihara, Funabashi, all of Japan

[73] Assignee: Nippon Kogaku K. K., Tokyo, Japan

[21] Appl. No.: 499,024

[22] Filed: Jun. 2, 1983

Related U.S. Application Data

[63] Continuation-in-part of Ser. No. 321,271, Nov. 13, 1981, abandoned.

[30] Foreign Application Priority Data

Nov. 18, 1980 [JP] Japan ..... 55-162340
Jun. 15, 1982 [JP] Japan ..... 57-89444[U]

[51] Int. Cl.[3] ..... B25B 11/00
[52] U.S. Cl. ..... 269/21
[58] Field of Search ..... 269/21, 13; 279/3 R; 51/235; 294/64 R, 64 A, 64 B; 248/362, 363

[56] References Cited

U.S. PATENT DOCUMENTS

| | | | |
|---|---|---|---|
| 631,898 | 8/1899 | Marsh | 269/21 |
| 661,840 | 11/1900 | Baker | 269/21 |
| 2,317,348 | 4/1943 | Wekeman | 269/21 |
| 2,723,775 | 11/1955 | Von Hofe et al. | 269/21 |
| 2,853,333 | 9/1958 | Littell | 294/64 R |
| 2,895,706 | 7/1959 | Blatherwick | 269/21 |
| 3,307,818 | 3/1967 | Cocito | 248/362 |
| 3,307,819 | 3/1967 | Cocito | 248/363 |
| 4,131,267 | 12/1978 | Ono et al. | 269/21 |

*Primary Examiner*—Robert C. Watson
*Attorney, Agent, or Firm*—Shapiro and Shapiro

[57] ABSTRACT

A device for holding a sheet-like sample includes table means including a reference surface capable of intimately contacting the surface of the sample and a groove formed in the reference surface and capable of being covered by the surface of the sample during the intimate contact, the groove being formed in the shape of a continuous spiral having its center substantially at the center of the reference surface, and exhaust means for exhausting the air in the groove covered by the surface of the sample.

7 Claims, 7 Drawing Figures

DEVICE FOR HOLDING A SHEET-LIKE SAMPLE

This is a continuation-in-part application of Ser. No. 321,271, filed Nov. 13, 1981, now abandoned.

BACKGROUND OF THE INVENTION

1. Field of the Invention

This invention relates to a device for holding a sheet-like sample while reforming it flatly.

2. Description of the Prior Art

Generally, in an exposure device wherein the pattern of a mask is transferred to the surface of a sheet-like sample such as a semiconductor wafer, the wafer and the mask each is held by holders and positioned in opposed relationship with each other. The wafer, during repetitive exposure, is subjected to a process involving heat treatments such as development of photoresist and etching. Accordingly, each time it is subjected to the process steps, the wafer creates therein distortion, warping or the like with respect to its planarity. Such distortion or warping greatly affects the drawback of the chip on the wafer. It is therefore known to vacuum-attract the wafer to a sample supporting table on which the wafer rests, namely, a wafer holder, and forcibly reform the warping or the like and thereafter effect the exposure.

As an example of the conventional wafer holder which facilitates vacuum attraction of wafer, there is known one which comprises a flat plate formed in its surface of high planarity with a plurality of concentric circular grooves and a plurality of radial grooves connecting the circular grooves to one another and having an exhaust port opening into the interior of the grooves. A wafer placed on the surface of this flat plate is brought into intimate contact with and held by said surface when the air in the grooves has been exhausted through the exhaust port. However, even if the wafer is attracted and fixed over its entire area, if there is present foreign material such as dust or the like which has adhered to the surface of the holder or the reverse side of the wafer during the preceding step of process, the wafer attracted thereonto often creates therein minute warping under the influence of the foreign material, and deteriorated surface accuracy of the surface of the wafer results in reduced resolution of the projected pattern. Adherence of such foreign material can be prevented to a certain degree of reducing the area of contact between the surface of the holder and the reverse side of the wafer, but it is also important to form grooves of such a pattern so that the foreign material adhering to the contact surface can readily escape into the grooves.

On the other hand, in the conventional wafer holder, where a wafer of a small diameter is to be attracted, leakage of air through the grooves occurs in the outer peripheral portion of the wafer to make the attraction insufficient because the distance from the aforementioned exhaust port to the outer periphery of the wafer becomes smaller, and it has therefore been necessary to replace the holder in accordance with the diameter of the wafer.

SUMMARY OF THE INVENTION

It is a primary object of the present invention to provide a device capable of holding a sample while reforming any distortion of the sample without being affected by any foreign material adhering to a sample supporting surface or to the reverse side of the sample.

It is another object of the present invention to provide a device capable of reliably holding any sample which is relatively small.

It is still another object of the present invention to provide a holder device which imparts a gentle variation rate of attraction over the entire surface of the sample, thereby avoiding applying any unreasonable attraction force to the sample.

The invention will become fully apparent from the following detailed description of an embodiment thereof taken in conjunction with the accompanying drawings.

DESCRIPTION OF THE PREFERRED EMBODIMENTS

Figure 1:
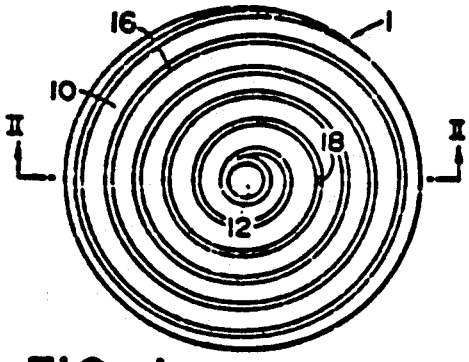
FIG. 1 is a front view of an embodiment of the present invention.
Figure 2:
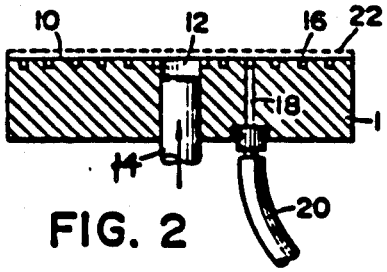
FIG. 2 is a cross-sectional view taken along the line II—II of FIG. 1.

Referring to FIGS. 1 and 2, the sample supporting surface 10 of a vacuum attraction type holder 1 has its surface accuracy enhanced by grinding or polishing substantially the entire surface of the holder and provides a reference flat surface for reforming a wafer. A through-aperture 12 is formed in the central portion of the holder. A push-up device 14 adapted to be projected from the sample supporting surface to raise a wafer resting on the sample supporting surface 10 is disposed in the through-aperture 12. A spiral groove 16 is formed in the surface 10 in the portion thereof from the periphery of the through-aperture 12 to the outer periphery of the holder. An exhaust hole 18 for exhausting the air in the groove 16 by an exhaust device 20 is formed at at least one location in the spiral groove 16. The exhaust hole 18 is formed inwardly of one half of the radius of the holder.

In FIG. 2, the cross-sectional shape of the spiral groove 16 is shown to be rectangular, but it is not restricted thereto. Further, the width, depth and pitch of the groove may be determined as required. The groove 16 is not restricted to a continuous single spiral, but may be a plurality of spirals.

When the air is exhausted through the exhaust hole 18 with a circular wafer 22 of such a size as to cover substantially the entire area of the sample supporting surface 10 of the holder being placed on the sample supporting surface 10 as indicated by the broken line in FIG. 2, and the pressure in the spiral groove 16 is decreased, the wafer 22 is flattened and reformed in accordance with the surface accuracy of the surface 10 and fixed to the holder. At such time, in the conventional holder, the surface accuracy of the wafer has been liable to be destroyed by dust or the like. However, if the spiral groove 16 of the invention is densely provided at a small pitch, the dust or the like will readily drop into the groove and the surface accuracy will be greatly improved.

Figure 3:
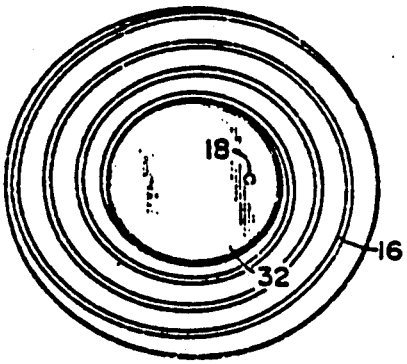
FIG. 3 is a plan view illustrating the condition in which the embodiment of FIG. 1 is used.
Figure 4:
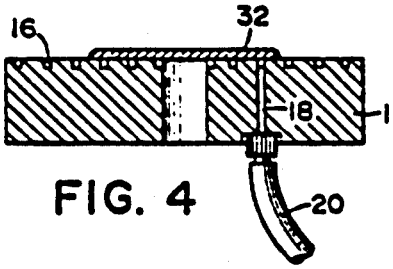
FIG. 4 is a cross-sectional view corresponding to FIG. 3.
Figure 5:
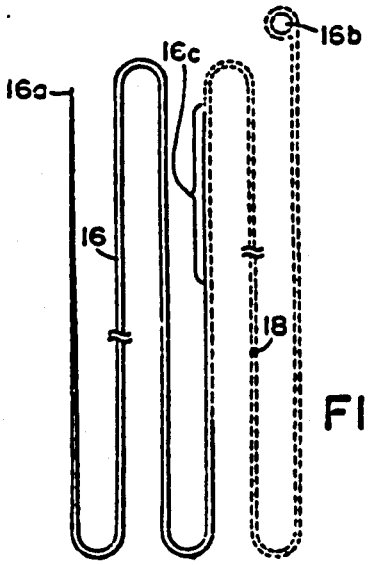
FIG. 5 is a developed view of a groove 16.

As shown in FIGS. 3 and 4, an exhaust port 18 is provided at a position completely covered by a circular wafer 32 having a smaller diameter than the holder 1 when the wafer 32 is placed with its center substantially coincident with the center of the holder. Accordingly, when such a small wafer 32 is vacuum-attracted, leaking occurs from the groove facing the outer periphery of the wafer 32, but the conductance from the hole 18 to the leak portion can be sufficiently decreased due to the spiral groove construction. This will now be described with reference to FIG. 5. FIG. 5 shows the manner in which the spiral groove 16 is stretched out, and the broken line indicates the portion covered by the wafer 32 and the solid line indicates the portion not covered by the wafer 32. The terminal end 16*a* of the spiral groove 16 corresponds to the outer peripheral portion of the holder, and the starting end 16*b* of the spiral groove corresponds to the central portion of the holder. The exhaust hole 18 is provided slightly radially inwardly of the outer periphery of the wafer 32, but the spiral groove is useful to considerably lengthen the distance in the direction of the groove from the hole 18 to the leak portion 16*c*. Accordingly, even if leaking occurs, the wafer 32 is fixed to the holder with a sufficient attraction force.

Although the above embodiment has been described with respect to a wafer holder, the present invention is also applicable to a sample supporting table for a sheet such as an ellipsomator. According to the present invention, an ordinary sheet which requires flattening can be made into a flat surface of high accuracy similar to the reference surface within the very short time required for the attraction simply by reforming using air pressure means.

While the exhaust hole 18 is provided in the spiral groove 16, the pressure within the spiral groove 16 may be decreased by utilizing the through-aperture 12. The through-aperture 12 is necessary in a wafer holder, but it is not always necessary in other types of holders.

Further, the sample supporting surface for reforming may be a surface having a predetermined curvature. This is determined by the shape of the sample. The spiral groove is not restricted to a circular shape, but when the sample supporting surface is rectangular, the groove may take a shape which goes toward the marginal portion while bending at right angles.

An increased number of exhaust holes is preferable in order to enhance universality for placing a wafer having greater diameter and for placing a plurality of wafers or plate members having different diameters. When a wafer having a great diameter of, for example, about 5 inches is vacuum-attracted to the holder having the hole 18 as shown in the embodiment of FIG. 1, there occurs a different attraction force between the peripheral portion and the center portion of the wafer.

Figure 6:
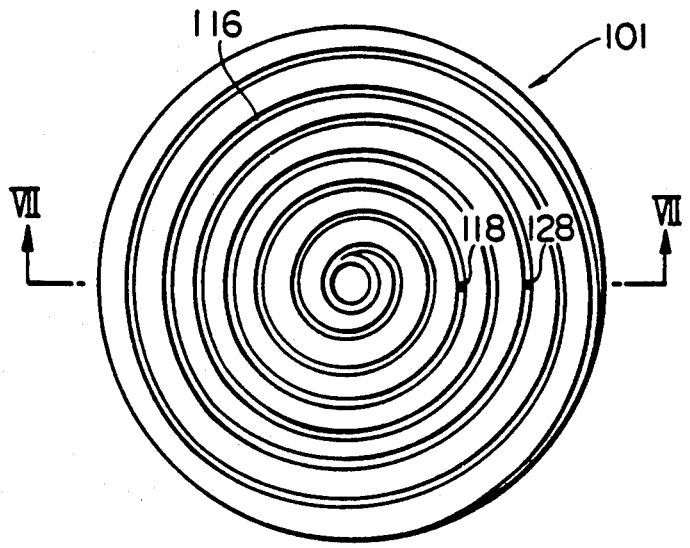
FIG. 6 is a front view of another embodiment of the present invention.
Figure 7:
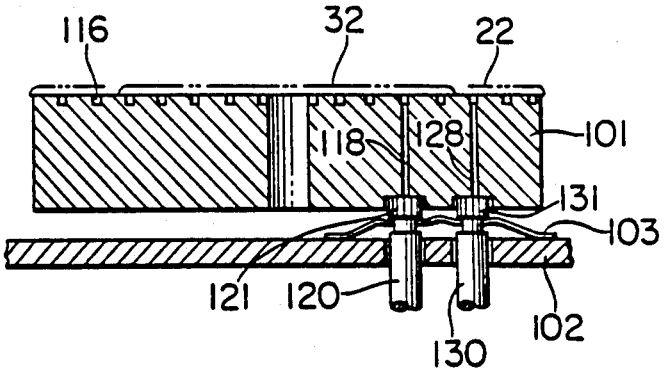
FIG. 7 is a cross-sectional view taken along the line VII—VII of FIG. 6.

To solve the problem, a holder 101, in the embodiment of FIG. 6, is provided with two exhaust holes 118, 128 in a spiral groove 116. These holes 118, 128 are provided at positions radially away from the center of the holder.

The positions of the holes 118, 128 are so determined that where a small wafer 32 having a diameter of less than 4 inches is placed and vacuum-attracted, the hole 118 may be covered with the wafer 32 and where a large wafer 22 having a diameter of about 5 inches is vacuum-attracted, the hole 128 may also be covered with the wafer 22. When the wafer 32 is vacuum-attracted to the holder 101, only an exhaust device 120 is operated, and when the wafer 22 of 5-inch diameter is vacuum-attracted, the exhaust device 120 and an exhaust device 130 both are operated. In this manner, wafers of greater diameters are vacuum-attracted very uniformly and a great attraction force is obtained, thus improving the flatness of the wafer.

Each of exhaust devices 120, 130 may be connected to each of couplings 121, 131. These couplings 121, 131 may be urged by a plate spring 103 (reacting against a fixed platform 102) to normally abut upon corresponding recesses at the bottom of the holder 101. The contact surface between the couplings 121, 131 and the holder 101 may be machined to prevent leakage of air to the outside. The fixed platform 102 and the holder 101 are preferably mechanically connected.

An example of a specific arrangement of the holes 118, 128 is given below. When wafers 3 inches and 4 inches in diameter are reformed with the same holder, the hole 118 is provided at a position about 32 mm away from the center of the holder and the hole 128 is provided at a position about 45 mm away from the center of the holder. In other words, when wafers having diameters of 3 inches and 4 inches are reformed, each of the holes 118, 128 is positioned within several millimeters (corresponding to several pitches of the spiral groove) from the peripheral portion of the wafer.

The number of the exhaust holes is not limited to the two as illustrated in the above embodiment. For example, another two exhaust holes may be provided at positions rotationally symmetric with respect to the center of the holder or more than four ports may be provided at a plurality of positions, so that similar technical advantages are, of course, obtained. In an exposure device, an object to be exposed need not be a wafer; it may be a mask. Where the exposure device is used as a photorepeater in which the mask forms a reticle, an appropriate holder dependent upon the mask may be used.

If universality to wafers having different diameters is neglected, it is preferable that the diameter of the supporting surface of the holder be formed slightly smaller than the diameter of the wafer so that the periphery of the wafer does not contact the supporting surface. This technique is very effective in keeping surface accuracy even if a wafer surface-coated with photoresist that extends into the bottom surface of the wafer is placed on the supporting surface. Although the outermost periphery of the spiral groove 116 is preferably made open in order to leak air to the outside, the outermost periphery may be closed in order to increase attractive force.

We claim:

1. A device for holding a sheet-like sample having a circular outline, comprising:

(a) table means including a reference surface capable of intimately contacting the surface of said sample, the reference surface having a width equal to or larger than the surface prescribed by said circular outline of said sample, and at least one groove formed in said reference surface and open along its length at said reference surface so as to be capable of being covered by the surface of said sample during said intimate contact, said groove being formed in the shape of at least one continuous circular spiral extending toward the periphery of said reference surface and having its center substantially at the center of said reference surface, said sample being located so that the center of the sample is at the center of said reference surface; and (b) exhaust means for exhausting the air in said groove covered by the surface of said sample at a position that is spaced from the center of said reference surface by a distance less than the radius of said sample.

2. A device according to claim 1, wherein said exhaust means includes a through-hole opening formed into said groove for exhausting the air therefrom.

3. A device according to claim 2, wherein the opening of said through-hole is provided in said groove between the center of said spiral and a portion intermediate the center and the perimeter of said reference surface.

4. A device for holding a sheet-like sample having a circular outline, comprising:

(a) table means including a reference surface capable of intimately contacting the surface of said sample, the reference surface having a width equal to or larger than the surface prescribed by said circular outline of said sample, and at least one groove formed in said reference surface and open along its length at said reference surface so as to be capable of being covered by the surface of said sample during said intimate contact, said groove being formed in the shape of at least one continuous circular spiral extending toward the periphery of said reference surface and having its center substantially at the center of said reference surface, said sample being located so that the center of the sample is at the center of said reference surface; and (b) exhaust means for exhausting the air in said groove covered by the surface of said sample, said exhaust means including a plurality of exhaust holes opened into said groove at positions spaced different distances from said center of said reference surface.

5. A device according to claim 4, wherein said exhaust means includes means for exhausting the air from one exhaust hole independently of another exhaust hole that is farther from the center of said reference surface.

6. A device for alternatively holding a plurality of plate members including a first plate member and a second plate member having a larger diameter than that of the first plate member, each of said plate members having a circular outline, comprising:

(a) table means including a reference surface having a larger diameter than said first plate member and capable of intimately contacting the surface of each of said plate members, and at least one groove formed in said reference surface and open along its length at said reference surface so as to be capable of being covered by the surface of said each plate member during said intimate contact, said groove being formed in the shape of a continuous circular spiral having its center substantially at the center of said reference surface and extending toward the periphery of said reference surface; and (b) exhaust means for exhausting the air in said groove covered by the surface of said each plate member, said exhaust means including an exhaust hole opened in said groove at a position that is spaced from the center of said reference surface by a distance less than the radius of said first plate member.

7. In an exposure device for transferring a pattern of a mask onto the surface of a semiconductor wafer in the shape of a disk, a device for holding said wafer, comprising:

(a) table means including a reference surface capable of intimately contacting a rear surface of said wafer and having a diameter equal to or larger than that of the disk of said wafer, and at least one groove formed in said reference surface and open along its length at said reference surface so as to be capable of being covered by said wafer, said wafer being arranged on said reference surface so that the center of the wafer is substantially at the center of said reference surface and said groove being formed in the shape of at least one continuous circular spiral having its center substantially at the center of said reference surface and extending toward the periphery of said reference surface; and (b) exhaust means for exhausting the air in said groove covered by said wafer at a position that is spaced from the center of said reference surface by a distance less than the radius of said wafer.

* * * * *